US005228271A

United States Patent [19]

Wallace

[11] Patent Number: 5,228,271

[45] Date of Patent: Jul. 20, 1993

[54] METHOD AND APPARATUS FOR COMPACTING SOFT GOODS

[75] Inventor: Arthur W. Wallace, Aurora, Colo.

[73] Assignee: Medivators, Inc., Cannon Falls, Minn.

[21] Appl. No.: 889,795

[22] Filed: May 28, 1992

[51] Int. Cl.[5] ..... B65B 1/26

[52] U.S. Cl. ..... 53/434; 53/405; 53/512

[58] Field of Search ..... 53/434, 432, 512, 510, 53/408, 405, 105; 383/103; 206/524.8

[56] References Cited

U.S. PATENT DOCUMENTS

| | | | |
|---|---|---|---|
| 2,349,588 | 5/1944 | Brand | 53/405 |
| 2,870,954 | 1/1959 | Kulesza | 206/524.8 |
| 2,927,722 | 3/1960 | Metzger | 383/103 X |
| 3,216,172 | 11/1965 | Piazze | 53/512 X |
| 4,754,595 | 7/1988 | Sanderson | 53/434 X |
| 4,890,637 | 1/1990 | Lamparter | 383/103 X |

OTHER PUBLICATIONS

StandPAK TM pouch with E-Z Zip ® resealable feature was made by KAPAKorporation (no date).

*Primary Examiner*—James F. Coan

*Attorney, Agent, or Firm*—Merchant, Gould, Smith, Edell, Welter & Schmidt

[57] ABSTRACT

An apparatus and method for evacuating gas from a container having collapsible walls. The apparatus is especially useful for removing air from flexible collapsible containers which comprise soft goods such as disposable hospital gowns, surgical paper and plastic wastes which must be transported and disposed of in a safe fashion.

8 Claims, 2 Drawing Sheets

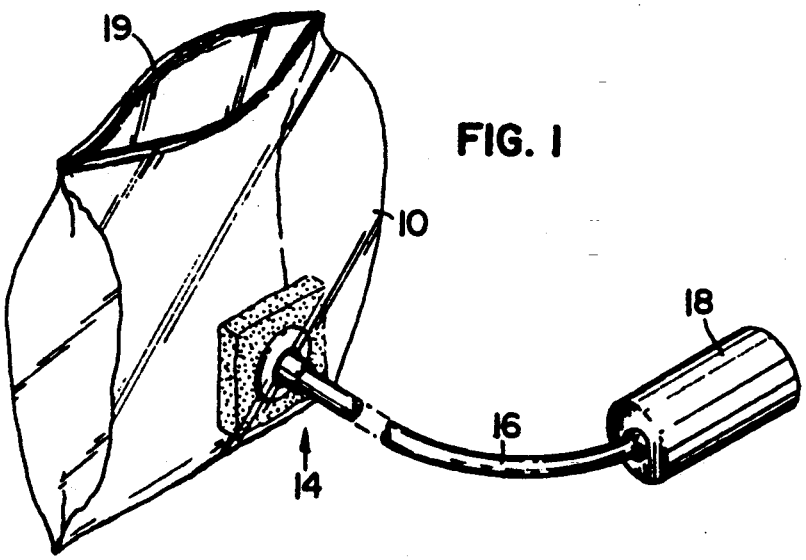
FIG. 1
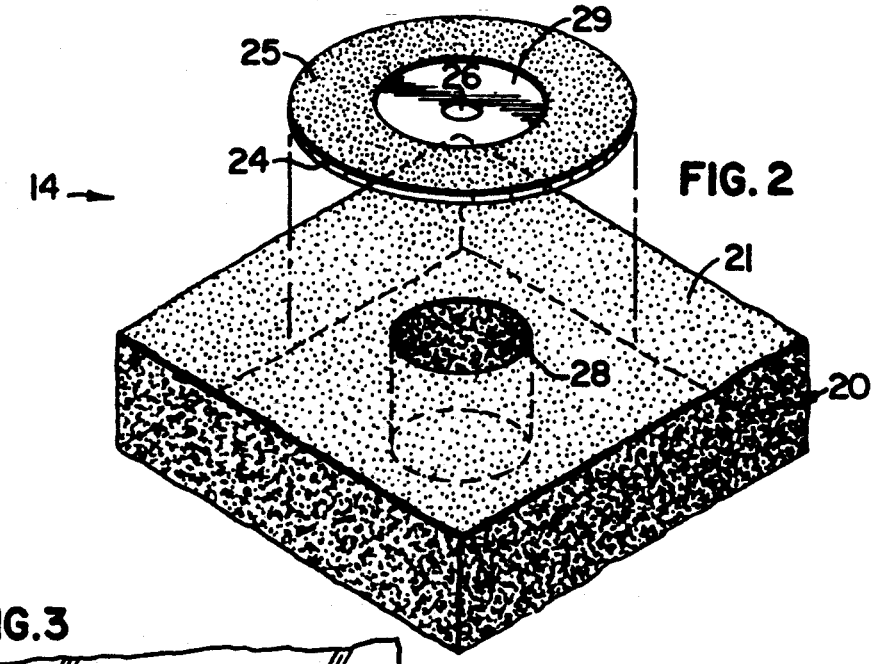
FIG. 2
FIG. 3
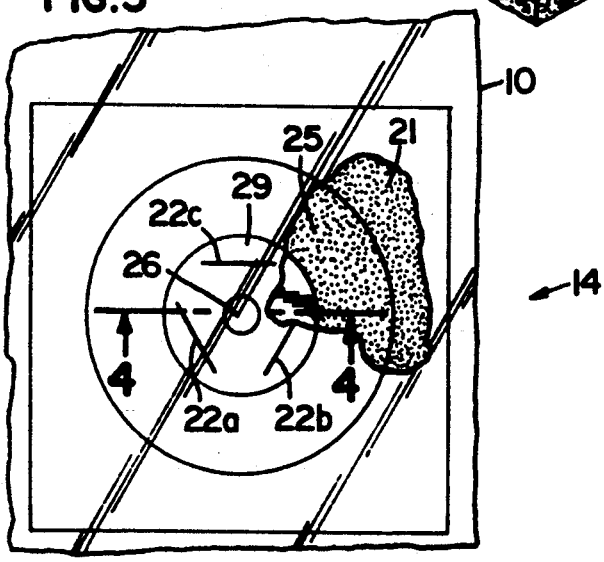

METHOD AND APPARATUS FOR COMPACTING SOFT GOODS

FIELD OF THE INVENTION

This invention relates to an improved method and apparatus for compacting soft goods such as hospital and surgical gowns and other disposable items into a self contained disposable bag.

BACKGROUND OF THE INVENTION

Presently, hospitals and other health care facilities have significant disposal problems with the soft wastes generated from surgical and medical procedures. Typically, during a single operation, the discarded surgical gowns, patient drapes, Mayo stand covers and other paper and plastic articles fill approximately three fifty-gallon waste receptacles. The receptacles are typically lined with a plastic bag, which, upon being filled, are closed and stored in a box of some manner, typically a corrugated box. Due to the fact that the blood soaked gowns, drapes and other articles could be infected with contagious and potentially deadly diseases, the waste articles are not disposed of in a typical fashion. Rather, they are packaged for shipment by truck or rail car to disposal sites which are designed for such contagious materials. The soft wastes are thereafter incinerated or stored for future disposal.

Problems encountered in the past with the disposal of waste articles concerned the large volume of air present in the shipping containers. Typically, when the disposable refuse is shipped via truck, the truck is only at 30–35% of its payload due to the low density of the packaged material being shipped. It is desireable to increase the density of the shipping containers, such that more refuse may be shipped with each load and thus increase the truck's payload closer to its maximum. It would be desirable to have the truck's payload be 70–80% of its maximum, thus resulting in the truck carrying more waste material each run. This results in fewer truck runs, translating into less fuel being used and more efficient transportation.

Further problems are encountered with the presence of corrugated boxes present in an operating room. Due to the high degree of sterility required, the presence of fibers from the boxes results in an unacceptable environment. Thus, the boxes must be wax-coated to diminish the likelihood that any free fibers will break free from the box. Thus, to avoid any possibility of fiber-contamination, it is desirable not to have any corrugated boxes present in the operating room.

Furthermore, it is desirable to increase the density of the refuse deposited in the hazardous waste disposal sites. There is limited space available for the disposal of such waste, and thus it is desirable to have the refuse in a compact and high density package.

The general concept of filling a bag with an article or articles, closing the bag and then orally drawing air through a separate valve to evacuate the bag of air and collapse the bag around the article is shown in U.S. Pat. No. 3,980,226. This patent generally discloses a bag with one end heat sealed and the other end open, articles being put in the bag, the open end tied off with wire tape and the entrapped air being evacuated from the bag through an oral evacuation means. However, this would not be an effective nor a safe method for infectious waste items.

U.S. Pat. No. 4,670,227 shows a system for handling bags filled with medical waste wherein the bags are collected and transported between a steam sterilizer and a trash compactor. U.S. Pat. No. 4,902,982 shows a container for collecting infectious waste wherein the container has a venting system for drawing off air when the lid of the container is shut and as it is being opened. U.S. Pat. No. 4,828,117 discloses the use of a bag that acts as a filter wherein air borne particles are drawn through the bag which then acts as a filter to collect the particles. However, none of these patents recognize or present any solution to the problem of packaging infectious soft goods.

There is a need for a method and apparatus for evacuating and collapsing a bag for transport. The increased use of disposable items in the health industries and other industries results in a need to effectively and economically package these wastes and dispose of them in an efficient manner.

SUMMARY OF THE INVENTION

An apparatus for substantially evacuating gas from a container having collapsible walls is described herein. The container has walls having an inner and outer face, the container having a first opening which may be sealingly shut, the apparatus comprising a valve means.

The valve means comprises a rigid member having a first and second face and having at least one aperture extending therethrough. The rigid member's first face has a first and second surface with the first surface being secured to a first portion and the second surface being proximate a second portion of the inner face of the container. The second surface circumscribes the aperture and the first surface circumscribes the second surface. The second portion of the inner face covering has at least one wall aperture extending therethrough.

A means is used to evacuate gas from the container through the wall aperture to cause the container to be substantially free of gas and the second portion is substantially vacuum sealed to the second surface causing the container to remain substantially evacuated after the evacuation means is removed from the container.

BRIEF DESCRIPTION OF THE DRAWINGS

FIG. 1 is a perspective view of the present invention employed in a waste receptacle.

FIG. 2 is an overview of the valve system of the present invention.

FIG. 3 is a cut-away of the present invention.

DETAILED DESCRIPTION OF THE INVENTION

Figure 4:
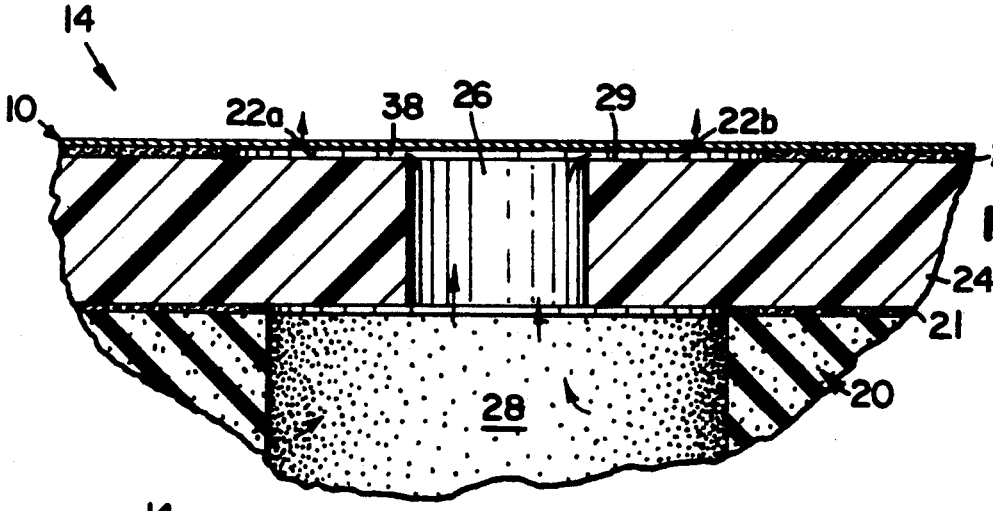
FIG. 4 is a cross-sectional view of the valve of the present invention prior to air evacuation of the waste receptacle.

The present invention provides a valve for use in evacuating gas from a container having collapsible walls. The container is intended for the storage of any articles which need to be transported in a packaged container. More specifically, the present invention is useful in hospitals and medical facilities wherein there is a large volume of discarded soft products such as hospital gowns, surgical drapes, Mayo stand covers, paper and plastic items, and any other types of material (hereinafter soft goods) which may be compacted in a container. Typically, in light of the infectious and potentially deadly diseases associated with the spillage of blood, the disposal of blood soaked items needs to be dealt with in a manner differently than other disposable items. Presently, many states have legislation dealing with the disposal of these infectious items.

During a typical surgical procedure, the valve of the present invention will be employed in a collapsible bag or container of some type and the valve will be proximate a vacuum source. The user will discard soft goods into the container and when the container is full, the top of the container will be sealingly shut. The manner in which the container may be sealingly shut can be a heat weld, a locking mechanism which is typically used in bags, or any other manner by which the top may be sealed in an air tight manner. After the top is sealed, the vacuum source is applied to the valve and the container shrinks down to substantially the size of soft goods encased therein. The vacuum source is thereafter removed from the valve, and the vacuum packed container remains evacuated of air. If the container is to be stored for a long period of time, a tape of some kind may be placed over the valve to further ensure no air leakage occurs into the bag at a later time.

The air evacuated packages of soft goods are thereafter shipped via truck or rail to disposal sites for articles having potentially contagious or infectious diseases. It is envisioned that the apparatus and method of the present invention may be also used for evacuating the air of other containers for the purpose of preserving space. Such other proposed uses include laundry services, packages for new or used clothing merchandise, and packages for food or the shipment of other bulk-type articles. The only limitation on the present invention is that the goods which are to be packaged must not have corners or points which, when packaged in the collapsible container, would puncture the package. Thus, it is envisioned that one could package products having sharp edges if a sufficiently thick wall ss present in the collapsible container.

In the preferred embodiment of the present invention, a collapsible plastic container, generally made of polyethylene, having a wall thickness of approximately 1 mil to 5 mil, is secured in a frame of some type with an opening on the top such that soft goods may be placed in the container. The valve of the present invention is located on the side or bottom of the container, wherein a vacuum hose may be readily attached to the valve. Upon filling the container with the soft goods, the top is sealed, a vacuum pump hose is applied to the valve and air is drawn out of the package. The package is thereafter ready to be transported in its compacted form.

Many different types of bags may be used for the present invention. The only limitation on the bag is that it is able to maintain an air tight seal and that it does not puncture from the articles contained therein.

The vacuum pump can be any apparatus which can create a vacuum sufficient to draw the air out of the container of the present invention. Typically, vacuums creating a vacuum of 20 to 30 inches of mercury are sufficient to evacuate the air from the collapsible bag. However, the vacuum source may be adjusted depending on the size of the container, the speed of which the air is to be evacuated, the properties of the soft articles contained therein and the wall thickness of the container.

FIG. 1 shows a container 10 of the present invention having a valve 14 connected to vacuum source 18 via hose 16. The attachment of hose 16 to valve 14 preferably involves a sealing material at the junction between hose 16 and valve 14, which creates a valve seat around valve 14. Typically, the junction involves a closed cell foam of some type which is secured to the end of hose 16 which creates a valve seat around valve 14. FIG. 1 shows container 10 in an open position. Soft goods are deposited into container 10 through opening 19. When container 10 is filled with soft goods, top 19 is sealed. Hose 16 is thereafter applied to valve 14, vacuum 18 is engaged and the air is drawn out of container 10. Typically, hospital vacuum systems are employed which are sensitive to liquids. Thus, it is preferred to employ a liquid trap of some kind between the container 10 and the vacuum source 18. Thus, a first hose extends from the vacuum source 18, to a liquid trap, and a second hose extends from the trap to the container 10. The second hose from the trap to the container 10 may be disposed of as well as the container 10 as a result of being exposed to infectious liquids.

Referring to FIG. 2, the preferred embodiment of the valve 14 is shown. In the preferred embodiment, open cell foam 20 has rigid member 24 secured thereto. The purpose of open cell foam 20 is to prevent an inner wall of the container 10 or soft goods from collapsing over aperture 26 thereby preventing further air from being drawn out of container 10. Any means which prevents the blockage of aperture 26 from soft goods or the inner wall may be used with the present invention. The open cell foam 20 can be any type of foam or other material which would allow air to pass through foam 20 and prevent closure of aperture 26 by material in the container 10 or by the opposite wall of the container 10.

Rigid member 24 can be any shape, although the preferred shape is circular in nature. The member 24 can be made up of any rigid material, preferably a rigid plastic such as polyvinyl chloride or other type of material. Rigid member 24 has an aperture 26 extending therethrough which is also aligned with aperture 28 shown extending through open cell foam 20. Aperture 28 is not necessary if open cell foam 20 is sufficiently air permeable. Apertures 26 and 28 can be any shape, although circular in nature is preferred for each of construction. The size of the apertures can vary, depending on the volume of air required to be drawn out of the container as well as the speed at which such air is to be drawn.

Rigid member 24 is secured to foam member 20 by adhesive 21. The adhesive 21 is preferably a pressure sensitive adhesive, which maintains its adhesive quality over an extended period of time. Typically, adhesive 21 can be a double sided tape which is applied to foam member 20.

Figure 5:
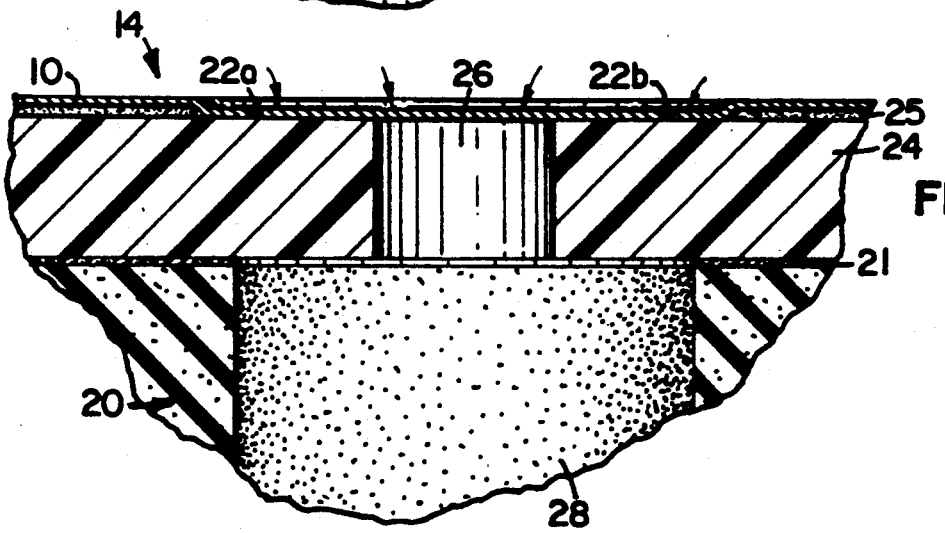
FIG. 5 is a cross-sectional view of the valve of the present invention after evacuation of air of the waste receptacle.

An outer portion of rigid member 24 must also be secured to container 10, thereby defining area 29. The "securing" can be an adhesive seal, a heat seal or any other airtight method of sealing or securing. An adhesive layer 25 is coated on the top face of rigid member 24 such that member 24 can be adhered to an inner wall of container 10. Adhesive 25 preferably is a pressure sensitive adhesive which can adhere the rigid member 24 to container 10. The whole valve 14, using adhesive layers 21 and 25 ar then secured to an inner wall of container 10. As discussed above and as shown in FIGS. 2, 4 and 5, adhesive 25 does not completely cover rigid member 24. Area 29 of FIG. 2 shows a portion of member 24 which is adhesive free. This area 29 allows air to be drawn through the valve 14, as shown in FIGS. 4 and 5, and will be described in detail below.

Referring to FIG. 3, a cut-away of the present invention is shown. The valve 14, in order to operate, must have at least one aperture extending through the side of container 10. FIG. 3 shows apertures 22*a*, 22*b* and 22*c*. Air is drawn out through the apertures 22 when the hose 16 of vacuum source 18 is positioned to form a valve seat around valve 14 and a vacuum is applied to valve 14.

The mating surface portion of the junction where hose 16 meets valve 14 must have a diameter extending beyond the area defined by the slits. In other words, if the diameter of hose 16 does not encompass completely the slit area, the junction created by hose 16 would be faulty and short circuit the air drawn through valve 14.

The apertures can be slits or circular perforations or any other type of aperture which would allow air to flow through the aperture of container 10. In the preferred embodiment, the apertures 22 are slits, and typically concentric to the opening 26. Six slits are preferred in an alternating, two concentric circle pattern. The number of slits or apertures is dependant on the volume and speed at which the air is to be drawn.

As air is drawn by vacuum 18 through apertures 22, bag 10 collapses around valve 14 as well as everything in the bag 10. Furthermore, slits 22*a, b* and *c* are pressed against surface 29 of rigid member 24, such that an air tight seal is maintained. Thus, as is evident from FIGS. 3 and 4, slits 22*a, b* and *c* should not to be positioned such that they overlap aperture 26 upon a vacuum being drawn. If the slits 22 were positioned in such a manner, air would leak through the slits 22 upon removal of the vacuum source 18 and the bag 10 would refill with air. However, if slits were positioned in such a manner, the invention would still be usable, although, a piece of tape of some kind would have to be immediately applied over the slits 22 upon withdrawing of the vacuum source 18. Thus, it is preferred to have the slits 22 not positioned in a manner that they will overlap the aperture 26 upon the drawing of the vacuum 18. However, if slits 22 are positioned in such a manner, other means must be taken to keep the vacuum seal tight.

FIGS. 4 and 5 show a cross-sectional view of the present invention, prior to air evacuation and post air evacuation respectively. FIG. 4 shows bag 10 extending horizontally across area 29 of member 24. Gap 38 is visible as the space between bag 10 and area 29. As a vacuum (not shown) is drawn on valve 14, air flows in the direction of the arrows of FIG. 4. Air flows through apertures 28, 26, through gap 38 and out apertures 22*a* and 22*b*. After the desired amount of air is drawn out, the hose 16 is removed, the inner wall of bag 10 is drawn flush against area 29, by atmospheric pressure being greater than the pressure within the bag. Apertures 22*a* and 22*b* are drawn flush against area 29, thus closing apertures from air passing through the apertures. Thus, an air tight seal is created, as shown in FIG. 5.

As will be apparent to those skilled in the art various other modifications can be carried out from the above disclosure without departing from the spirit and scope of the invention.

I claim:

1. An apparatus for substantially evacuating gas from a container having flexible collapsible walls, said walls having an inner and outer face, said container having a first opening which may be sealingly shut, said apparatus comprising:

a. a valve means located on said inner face, said valve means comprising a rigid member having a first and second face and having at least one aperture extending therethrough, said rigid member's first face having a first and second surface, said first surface being secured to a first portion and said second surface being proximate a second portion of said inner face of said container, said second surface circumscribing said aperture, said first surface circumscribing said second surface, said second portion of said inner face having at least one wall aperture extending therethrough; and b. means to evacuate gas from said container through said wall aperture to cause said container to be substantially free of gas, said second portion being substantially vacuum sealed to said second surface causing said container to remain substantially evacuated after said evacuation means is removed from said container.

2. The apparatus of claim 1 wherein said collapsible container is a plastic bag.

3. The apparatus of claim 1 wherein said rigid member is a polymeric disk, said second face of said disk secured to open cell foam having an aperture extending through said foam.

4. The apparatus of claim 2 wherein said wall aperture comprises a plurality of slits cut through said plastic bag.

5. A method for substantially evacuating gas from a container having flexible collapsible walls, said method comprising the steps of:

a. providing an apparatus comprising a valve means located on said inner face, said valve means comprising a rigid member having a first and second face and having at least one aperture extending therethrough, said rigid member's first face having a first and second surface, said first surface being secured to a first portion and said second surface being proximate a second portion of said inner face of said container, said second surface circumscribing said aperture, said surface circumscribing said second surface, said second portion of said inner face covering having at least one wall aperture extending therethrough; and b. evacuating a gas utilizing a vacuum source to evacuate gas from said container through said aperture to cause said container to be substantially free of gas, said second portion being substantially vacuum sealed to said second surface causing said container to remain substantially evacuated after said evacuation means is removed from said container; and c. removing said vacuum force from said container, wherein said collapsed container remains substantially collapsed for transport.

6. The apparatus of claim 5 wherein said collapsible container is a plastic bag.

7. The apparatus of claim 5 wherein said rigid member is a polymeric disk, said disk secured to open cell foam having an aperture extending through said foam and circumscribing said second surface of said rigid member aperture.

8. The apparatus of claim 6 wherein said wall aperture comprises a plurality of slits cut through said plastic bag.

* * * * *